US007901239B2

(12) United States Patent
Weber

(10) Patent No.: US 7,901,239 B2
(45) Date of Patent: Mar. 8, 2011

(54) CABLE CONNECTOR

(75) Inventor: Ron Christian Weber, Vught (NL)

(73) Assignee: FCI, Versailles (FR)

( * ) Notice: Subject to any disclaimer, the term of this patent is extended or adjusted under 35 U.S.C. 154(b) by 1056 days.

(21) Appl. No.: 11/659,760

(22) PCT Filed: Jul. 12, 2005

(86) PCT No.: PCT/EP2005/007526
§ 371 (c)(1),
(2), (4) Date: Feb. 8, 2007

(87) PCT Pub. No.: WO2006/015679
PCT Pub. Date: Feb. 16, 2006

(65) Prior Publication Data

US 2007/0275591 A1 Nov. 29, 2007

(30) Foreign Application Priority Data

Aug. 13, 2004 (NL) ..... 1026842

(51) Int. Cl.
*H01R 13/58* (2006.01)

(52) U.S. Cl. ..... 439/455; 439/607.47; 439/902

(58) Field of Classification Search ..... 439/455, 439/454, 453, 466, 465, 468, 607.47–607.51, 439/902
See application file for complete search history.

(56) References Cited

U.S. PATENT DOCUMENTS

| | | | | |
|---|---|---|---|---|
| 5,315,679 | A * | 5/1994 | Baldwin et al. | 385/76 |
| 5,466,175 | A * | 11/1995 | Onoda | 439/607.48 |
| 6,602,090 | B2 * | 8/2003 | Kato | 439/455 |
| 6,821,160 | B2 * | 11/2004 | Fink et al. | 439/701 |
| 6,991,493 | B2 * | 1/2006 | Matsui et al. | 439/579 |
| 7,442,072 | B2 * | 10/2008 | Droesbeke et al. | 439/471 |
| 7,503,776 | B1 * | 3/2009 | Pavlovic et al. | 439/98 |
| 2005/0118858 | A1 * | 6/2005 | Matsui et al. | 439/410 |

FOREIGN PATENT DOCUMENTS

| | | | |
|---|---|---|---|
| EP | 1 115 178 | A2 | 7/2001 |
| WO | WO 2004/004071 | A2 | 1/2004 |

* cited by examiner

*Primary Examiner* — Neil Abrams
*Assistant Examiner* — Phuongchi T Nguyen
(74) *Attorney, Agent, or Firm* — Harrington & Smith

(57) ABSTRACT

The invention relates to a cable connector including a housing and ferrule receiving structures for receiving ferrule systems of at least two cables. Each of said ferrule receiving structures is adapted to accommodate a flange of at least one of said ferrule systems and said ferrule receiving structures are arranged such that adjacent flanges of said ferrule systems substantially abut each other or at least partially overlap.

13 Claims, 6 Drawing Sheets

CABLE CONNECTOR

The invention relates to a cable connector comprising a housing and ferrule receiving structures for receiving ferrule systems of at least two cables.

EP-A-1 122 834 discloses a cable connector comprising a housing with at least two cable exits and two locations for receiving a strain relief means. The receiving locations are staggered with respect to each other and are placed at an offset with respect to a center plane of the connector.

The trend in industries where cable connectors of the above-mentioned type are typically employed, such as telecom, is towards high density connection panels allowing high speed communication. The cable connector of the prior art is disadvantageous in that staggering and offsetting of the receiving locations results in increased dimensions for the cable connector, which is detrimental to the use in high density panels.

It is an object of the present invention to provide a cable connector for terminating at least two cables with reduced dimensions.

This object is achieved by a cable connector characterized in that each of said ferrule receiving structures is adapted to accommodate a flange of at least one of said ferrule systems and said ferrule receiving structures are arranged such that adjacent flanges of said ferrule systems substantially abut each other or at least partially overlap. The construction of the cable connector according to the invention makes the ferrule systems of the cables determine both the distance between adjacent cables and the electromagnetic shielding performance of the cable connector. Accordingly, such a cable connector can be optimized with respect to its dimensions and electromagnetic shielding performance by the shape and arrangement of the ferrule receiving structures. It is noted that in the case of abutment of adjacent flanges, a slit may still be present between the adjacent flanges. However, such a slit should according to the invention be negligible for electromagnetic shielding performance. The still allowable dimensions of the slit depend e.g. on the frequency of the signals transmitted through the cable. Finally, the flanges of the ferrule systems contribute to the strain relief performance of the cable connector.

In an embodiment of the invention, the housing comprises a first cover half and a second cover half, said first cover half and second cover half defining a split plane of said connector, each of said ferrule receiving structures being arranged substantially symmetrically with respect to said split plane. The prior art cable connector has an offset of the ferrule receiving structures with respect to the split plane of the connector. The absence of such an offset reduces the dimensions of the cable connector according to this embodiment of the invention.

In an embodiment of the invention, at least one the cable entries of the cable connector comprises one or more retention ribs. As the ferrule system of the cable is preferably applied over the shielding braid of the cable against the cable jacket and accordingly does not cover the cable jacket, this cable jacket might easily pop out of the cable entry when forces are exerted on the cable. The retention ribs in the cable entry prevent the cable jacket from popping out of the cable connector and avoid the need to attach the ferrule system to the cable near the section where the flange is provided. Further, the retention ribs enhance the cable bend relief performance of the cable connector. In a preferred embodiment of the invention, these retention ribs are chamfered with respect to the split plane of the cable connector. Consequently, closure of the cover halves to complete the cable entry results in a relaxation space for the cable jacket at the chamfered sections near the split plane preventing the cable jacket to get squeezed during closure.

In an embodiment of the invention, the ferrule receiving structures comprise a non-circular shaped section adapted to cooperate with a corresponding non-circular shaped part of said ferrule system. Such a construction results in an increased twist relief performance of the cable connector.

It should be noted that the above embodiments, or aspects thereof, can be combined.

The invention further relates to a cable connector assembly comprising a cable connector as described above and at least a first cable provided with a first ferrule system comprising a first flange and an adjacent second cable provided with a second ferrule system comprising a second flange, wherein said first and second ferrule system are adapted to receive a portion of, respectively, said adjacent second flange and said adjacent first flange. By structuring the ferrule systems such that they can accommodate a part of an adjacent flange, the cables are positioned closely together and appropriate electromagnetic shielding performance is maintained. Accordingly, the cable connector dimensions can be reduced. Preferably, each ferrule system comprises an inner ferrule and an outer ferrule arranged with respect to each other to determine a gap to receive said portion of said adjacent flange.

The invention also relates to a ferrule system for use in a cable connector or a cable connector assembly as described above, wherein said ferrule system comprises a flange and a structure to receive a flange of an adjacent ferrule system. Such a ferrule system allows for closely positioning of the cables in a cable connector and thus for a cable connector of reduced dimensions. In an embodiment of the invention, the ferrule system comprises an inner ferrule and an outer ferrule arranged with respect to each other to determine said structure to receive said adjacent flange.

In an embodiment of the invention, the ferrule system has an outer shape selected from the group comprising polygonal, hexagonal, square, elliptical, and D-shaped, which is advantageous for the twist relief performance of the cable connector assembly.

The invention will be further illustrated with reference to the attached drawings, which schematically show a preferred embodiment according to the invention. It will be understood that the invention is not in any way restricted to this specific and preferred embodiment.

Figure 1:
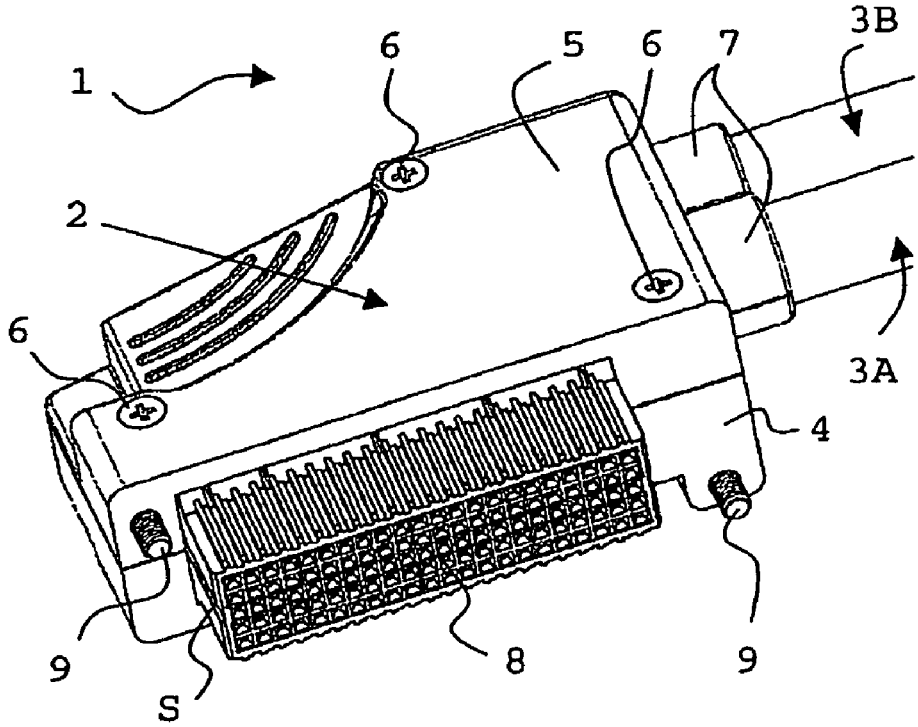
FIG. 1 shows a cable connector assembly according to an embodiment of the invention.

FIG. 1 shows a cable connector assembly 1 comprising a right-angled cable connector 2 and cables 3A and 3B. The cable connector 2 has a housing with cover halves 4, 5 mounted to each other by screws 6. The cover halves 4 and 5 further each determine an external portion of a cable entry 7 at the back side of the cable connector that allows the cables 3A, 3B to enter the housing determined by the cover halves 4, 5.

At the mating side of the cable connector 2 a shroud S protrudes from the housing. Terminal blocks 8 provide terminals for terminating wires (shown in FIG. 5A) of the cables 3A and 3B. The mating side also has mounting screws 9 to lock the cable connector 2 to a counterpart, such as a connector panel.

Figure 2A:
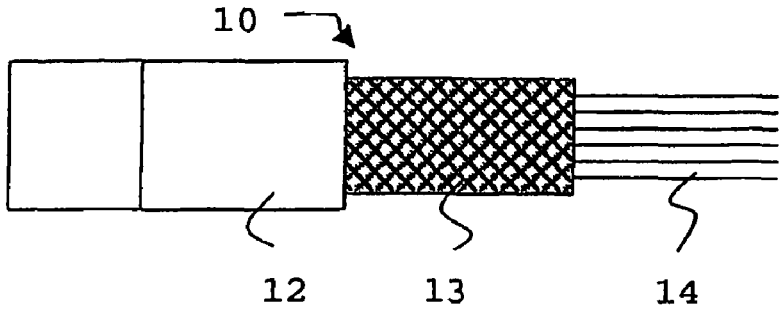
FIGS. 2A-2C show a cable with a ferrule system according to an embodiment of the invention.
Figure 2B:
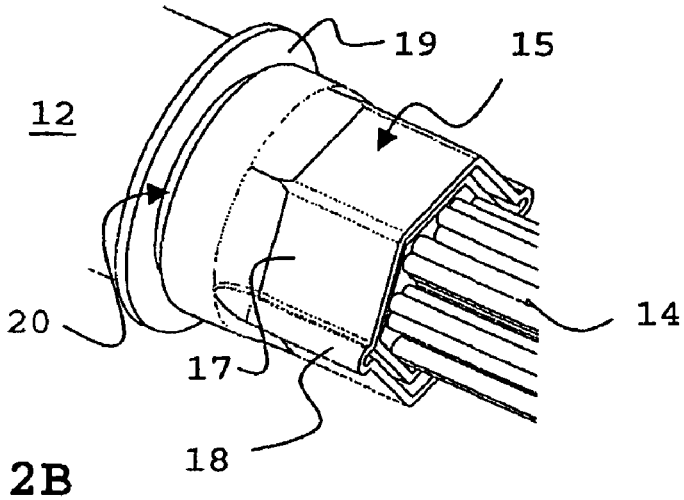
Figure 2C:
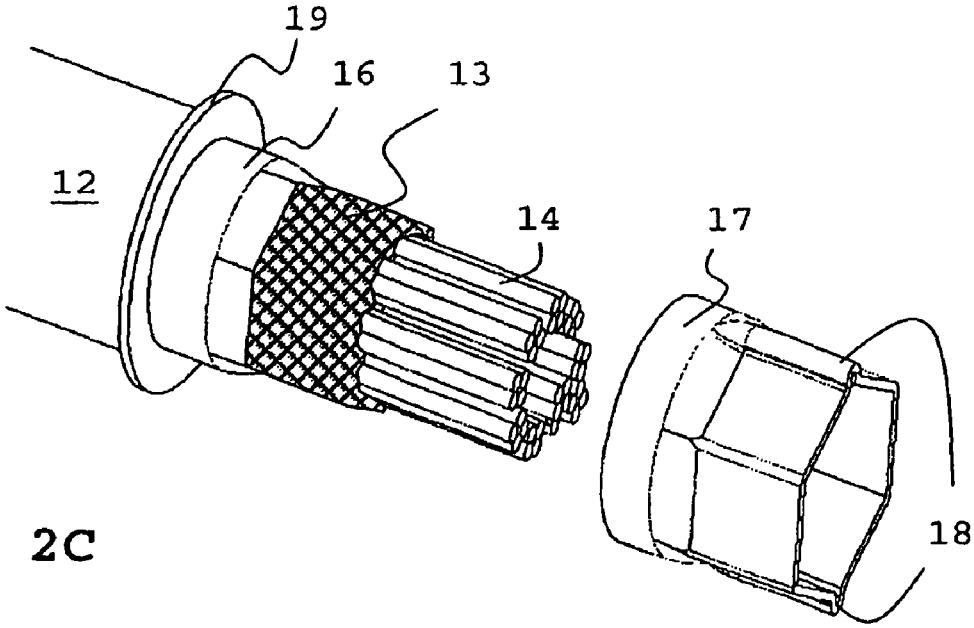

FIGS. 2A-2C show a cable 10 with a ferrule system 15 according to an embodiment of the invention. The cable 10 comprises a cable jacket 12, a shielding braid 13 and a plurality of wires 14 to be terminated at the terminal block housing 8 of the cable connector 2.

In FIGS. 2B and 2C, the cable 10 is provided with the ferrule system 15. The ferrule system 15 comprises an inner ferrule 16 fitting around the shielding braid 13 of the cable 10. The inner ferrule 16 is positioned against the cable jacket 12. The shielding braid 13 is folded back over the inner ferrule 16 and then an outer ferrule 17 is positioned over the back folded part of the shielding braid 13. The inner ferrule 16 and outer ferrule 17 are crimped in one operation with a hexagonal shaped tool with a predefined deformation zone, allowing deformation of material of the outer ferrule into predefined ears 18. FIG. 2C shows the situation wherein the crimped outer ferrule 17 is removed from the cable 10 for clarity purposes.

The inner ferrule 16 further comprises a flange 19. It should be appreciated that, although the flange 19 has a circular shape in the depicted embodiment, it may have non-circular shapes, such as hexagonal, square, elliptical, a D-shape etc. as well.

The inner ferrule 16 and outer ferrule 17 are arranged with respect to each other to determine a structure, displayed as a gap 20, to receive a flange 19 of an adjacent ferrule system 15.

Figure 3A:
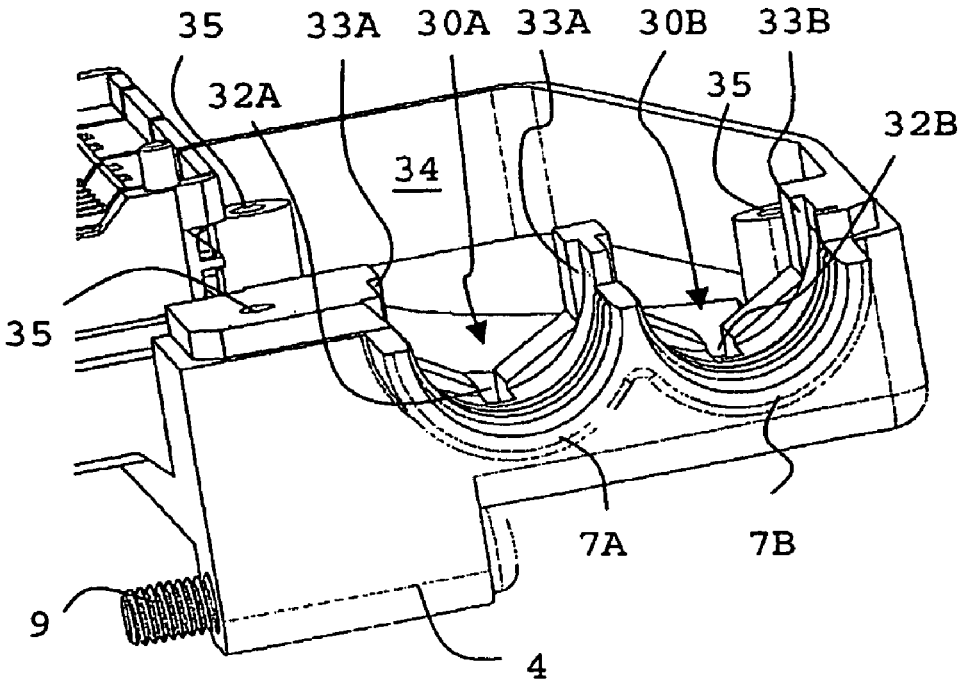
FIGS. 3A and 3B show a cover half of the cable connector of the cable connector assembly shown in FIG. 1 from different perspectives.
Figure 3B:
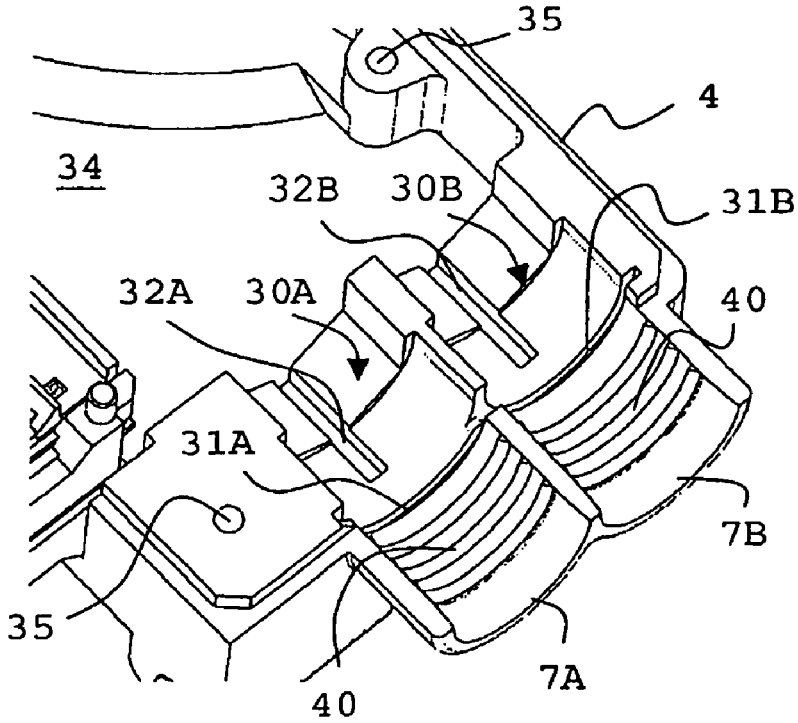

FIGS. 3A and 3B show the inner structure of the cover half 4 of the cable connector 2 depicted in FIG. 1 from different perspectives.

The cover half 4 has a first ferrule receiving structure 30A for the ferrule system 15A of the cable 3A and a second ferrule receiving structure 30B for the ferrule system 15B of the cable 3B. The ferrule receiving structures 30A and 30B are located at the back side of the cable connector 2 just behind the cable entries 7A and 7B. The ferrule receiving structures 30A and 30B are arranged symmetrically with respect to an imaginary split plane defined by the separation plane of the cover halves 4 and 5, i.e. the ferrule receiving structure 30A formed in the cover half 4 is substantially identical to the ferrule receiving structure 30A formed in the cover half 5. The split plane is illustrated schematically in FIG. 4.

Figure 5A:
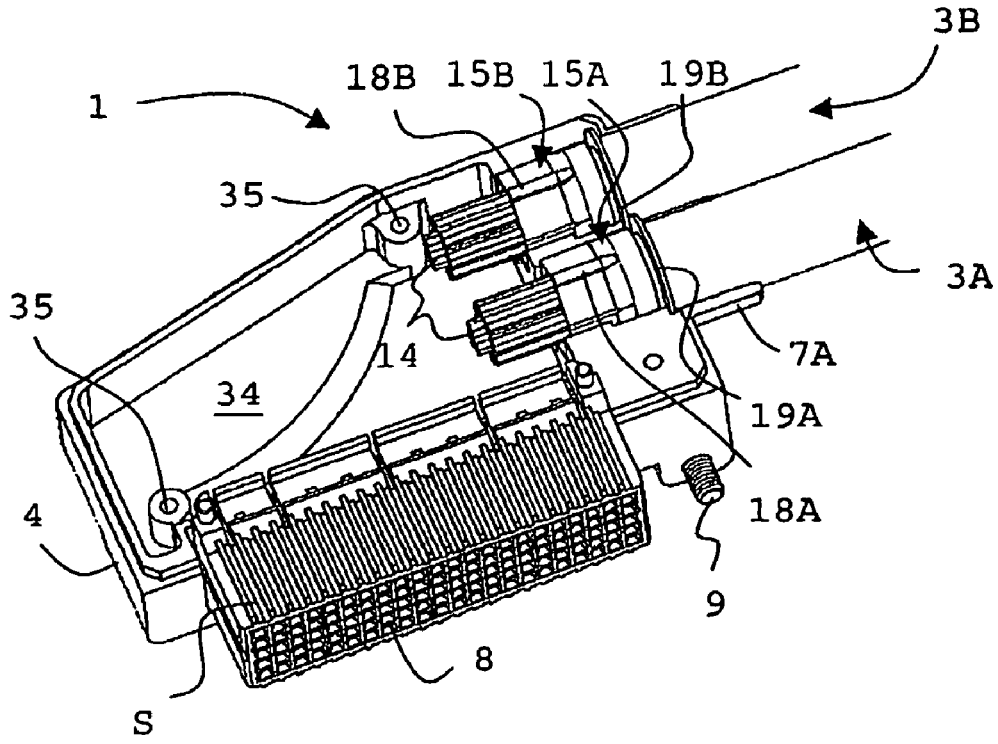
FIGS. 5A and 5B shows the cable connector of FIG. 3A provided with the cable of FIG. 2C.
Figure 5B:
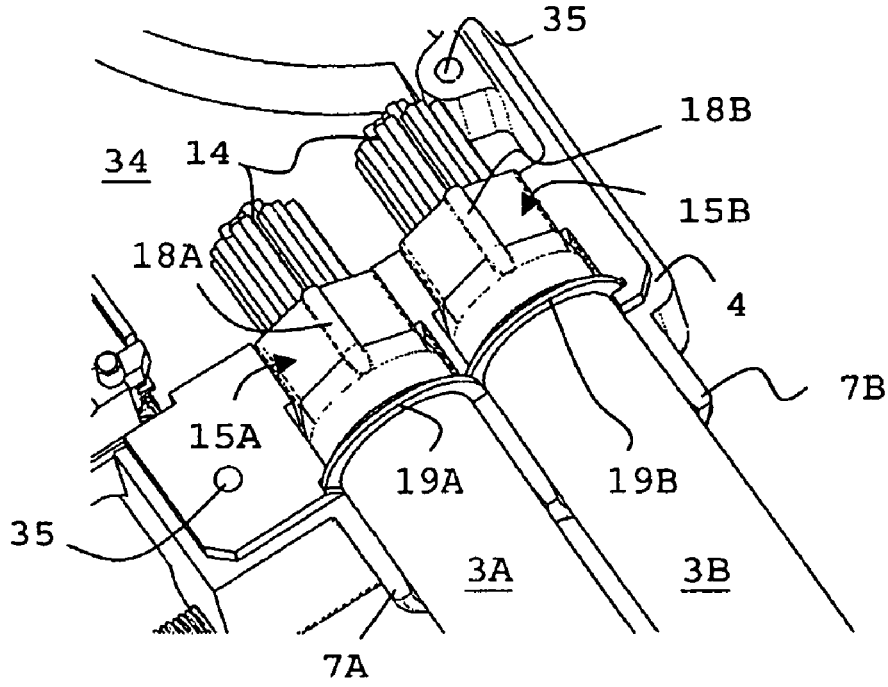

The ferrule receiving structures 30A and 30B comprise recesses 31A and 31B to accommodate the flanges 19A and 19B of the ferrule systems 15A and 15B. As most clearly shown in FIG. 3B, the ferrule receiving structures 30A and 30B are arranged such that adjacent flanges 19A and 19B of the ferrule systems 30A or 30B at least partially overlap. This is illustrated in FIGS. 5A and 5B.

Further, the ferrule receiving structures 30A and 30B comprise a structure 32A and 32B adapted to cooperate with the ears 18A respectively 18B of the ferrule systems 15A and 15B. The cooperation of these elements contributes to the twist relief performance of the cable connector assembly 1. The ferrule receiving structures 30A and 30B also comprise positioning surfaces 33A, 33B adapted to accommodate the external structure of the outer ferrule 17A, 17B of the ferrule system 15A, 15B. It should be appreciated that the shape of the ferrule receiving structures 30A, 30B should be tuned to the external shape and dimensions of the ferrule systems 15A, 15B, including the flanges 19A, 19B. Preferably, the ferrule receiving structures 30A and 30B comprise a polygon shaped section adapted to cooperate with a corresponding polygon shaped part of the ferrule system 15A, 15B. The polygon shape is advantageous for the twist relief performance of the cable connector assembly 1.

Finally, the cover half 4 has an internal space 34 for the wires 14 of the cables 3A and 3B and threaded holes 35 to receive the screws 6 for mounting the top cover half 5 to the cover half 4.

The cable entries 7A and 7B for the cables 3A and 3B are provided with retention ribs 40. These retention ribs 40, albeit in a larger number, are also shown in the detailed image of the cable entry 7A displayed in FIG. 4. The retention ribs 40 provide a saw tooth profile in the cable entry 7A for interaction with the cable jacket 12 of the cable 3A. As the ferrule system 15A of the cable 3A is applied over the shielding braid 13 of the cable 3A and positioned against the cable jacket 12, the ferrule system 15A is not crimped on the cable jacket 12. The retention ribs 40 prevent the cable jacket 12 from popping out of the cable connector entry 7A when forces are exerted on the cable 3A. These forces make the cable jacket 12 dig into the space between the retention ribs 40. Further, the retention ribs 40 enhance the cable bend relief performance of the cable connector 2. A similar profile may be present for the cable entry 7B.

Figure 4:
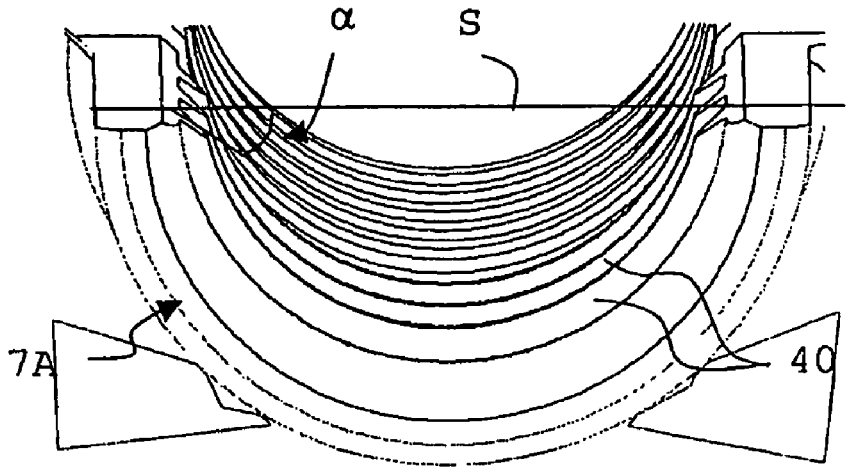
FIG. 4 shows a detailed image of a cable entry of the cable connector of FIG. 3A.

The cover halves 4 and 5 of the cable connector housing define an imaginary split plane, schematically illustrated by the line S in FIG. 4. The retention ribs 40 are chamfered with respect to this split plane by an angle $\alpha$. The angle $\alpha$ preferably is 45°. Consequently, closure of the cover halves 4 and 5 to complete the cable entry 7A results in a relaxation space for the cable jacket 12 at the chamfered sections near the split plane S preventing the cable jacket 12 to get squeezed during completion of the cable connector assembly 1.

FIGS. 5A and 5B depict the cable connector assembly 1 with cables 3A, 3B provided with ferrule systems 15A, 15B as shown in FIG. 2B mounted in the cable connector 2. Identical reference numbers have been used to indicate identical parts of the cable connector assembly 1. Clearly portions of the flanges 19A and 19B overlap with portions of the adjacent flange 19B respectively 19A. Consequently, when the cable connector assembly 1 is completed by mounting the top cover half 5, a fully closed cable connector 2 is obtained with reduced dimensions and appropriate electromagnetic shielding performance. No additional parts are employed to obtain the closed cable connector 2 near the back side of the cable connector 2.

The internal structure of the cable connector cover halves 4, 5 allows the ferrule systems 15A and 15B to be arranged such that the flanges 19A, 19B overlap. The ferrule systems 15A, 15B are shaped such that they can accommodate a part of an adjacent flange 19B, 19A. In FIGS. 5A and 5B, this effect is facilitated by the provision the gap 20 between the inner ferrule 16A, 16B and the outer ferrule 17A, 17B for the flanges 19A and 19B. Accordingly, the respective flanges 19A, 19B have a slightly staggered arrangement.

The flanges 19A and 19B are positioned in the recesses 31A and 31B, enhancing the strain relief performance of the cable connector assembly 1.

Further, the ear sections 18A and 18B, obtained by hexagonal crimping of the inner ferrules 16A and 16B and the outer ferrules 17A and 17B on the respective cables 3A and 3B, are positioned in the structures 32A and 32B of the ferrule receiving portions 30A and 30B. Consequently, the twist relief performance of the cable connector assembly is enhanced.

It should be noted that the wires 14 of the cables 3A and 3B are typically connected to terminals of the terminal blocks 8 before insertion in shroud S and mounting the top cover half 5.

Figure 6A:
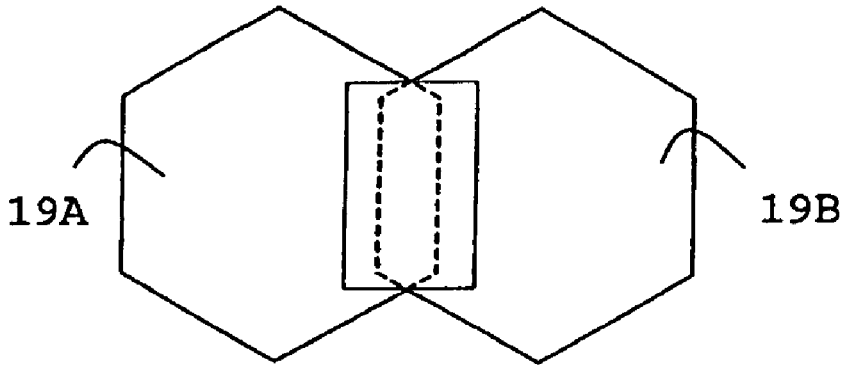
FIGS. 6A-6C show schematic illustrations of different embodiments of flange arrangements.
Figure 6B:
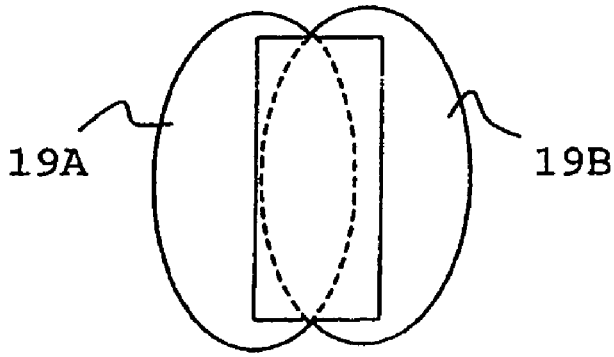
Figure 6C:
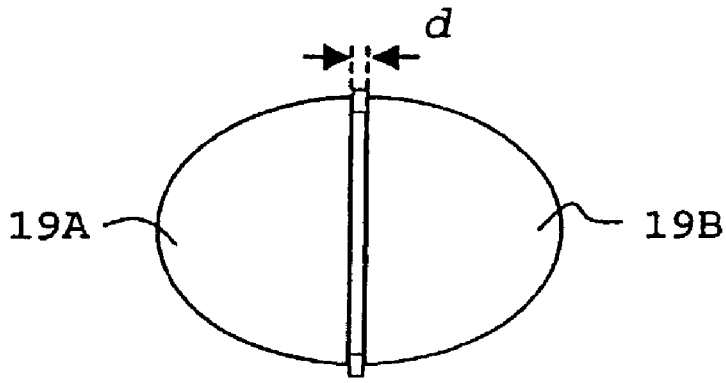

It should be noted that the above-described embodiment for the cable connector 2, the cable connector assembly 1 and the ferrule system 15 does not limit the invention; further modifications are contemplated, such as providing the ferrule systems 15A and 15B with non-circular flanges 19A, 19B as depicted in FIGS. 6A-6C. In FIG. 6A the flanges 19A and 19B have a hexagonal outer shape and overlap by staggering these flanges, as indicated by the dashed lines. In FIG. 6B an elliptical shape is shown for the flanges 19A, 19B, again in an overlapping arrangement. FIG. 6C shows a configuration with D-shaped flanges 19A and 19B that ideally abut each other at their flat sides, such that the cables 3A and 3B may contact each other, resulting in a further reduction of the dimensions of the cable connector 2. This configuration, however, may in practice yield a negligibly small slit d between the flanges 19A and 19D. Such a small slit d however is not detrimental for the electromagnetic shielding performance of the cable connector assembly 1. Other shapes for the flanges 19A, 19B, either abutting each other (with a possible small slit d) or overlapping each other fall under the scope of the present invention as well. The dimensions of the flanges may vary.

Further, the retention ribs 40 may have any shape or profile, such as staggered and/or intermittent ribs in the first cover half 4 and second cover half 5, as long as the function of cooperating with the cable jacket 12 can be fulfilled.

Also, the deformation sections 18A, 18B on the outer ferrule 17A, 17B can have other shapes.

Furthermore, the cable connector 2 may be suited for more than two cables 3A, 3B with the ferrule receiving structures 30 appropriately shaped and arranged to fulfill the purpose of the invention.

Figure 7:
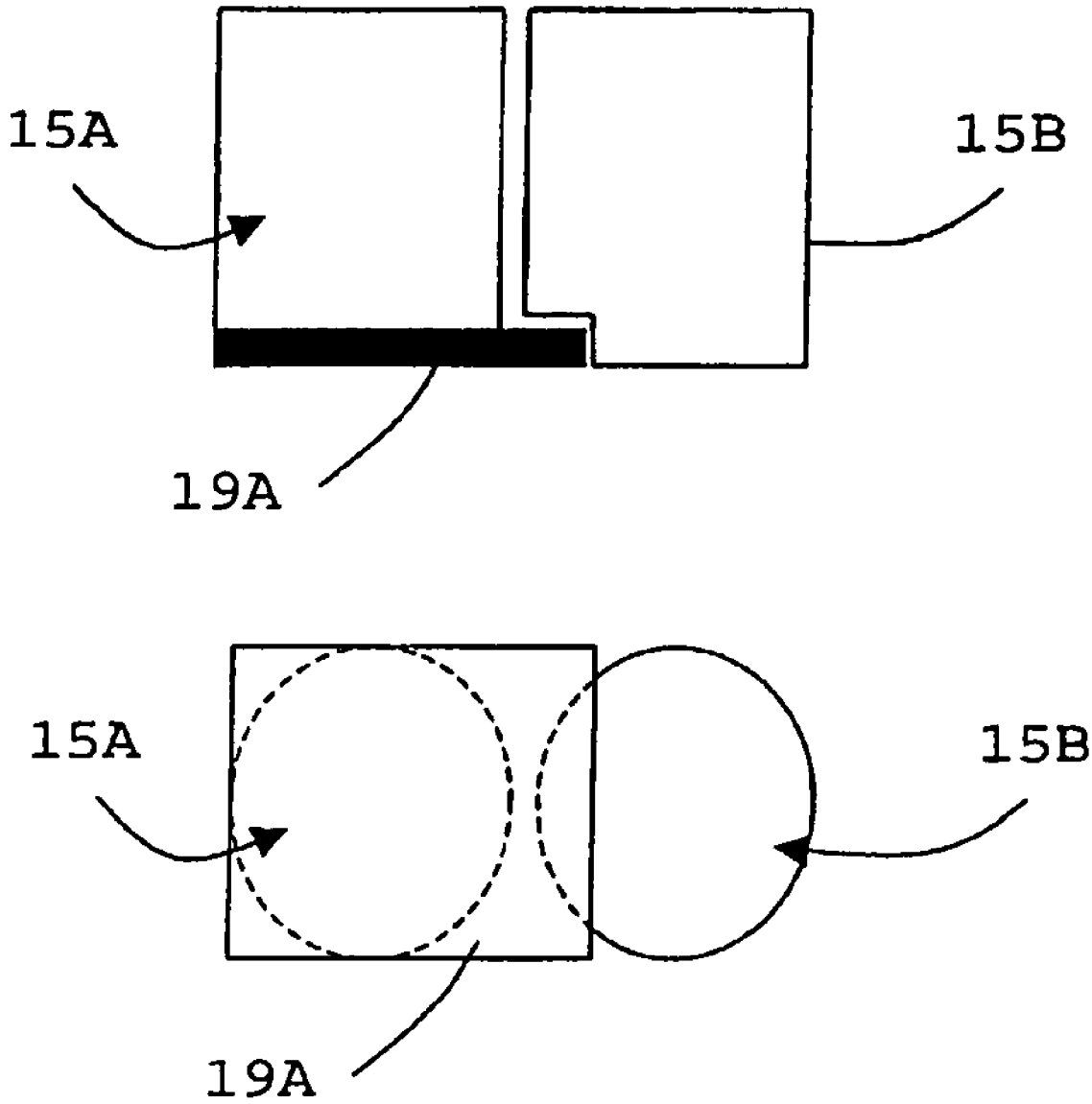
FIG. 7 shows a schematic illustration of an alternative configuration of cables with ferrule systems.

Although preferably, the ferrule systems 15A, 15B are identical in shape, the advantage of the invention can also be obtained by ferrule systems of different shape. Accordingly, the invention also relates to a cable connector 2 comprising a housing and at least a first ferrule receiving structure 30A for receiving a first ferrule system 15A with a flange 19A of a first cable 3A and a second ferrule receiving structure 30B for receiving a second ferrule system 15B of a second cable 3B, wherein said first receiving structure 30A and second receiving structure 30B are adapted to accommodate said flange 19A and said flange 19A is adapted to cooperate with said second ferrule system to close said cable connector 2 near a cable entry 7A, 7B. Such a configuration is schematically illustrated in FIG. 7.

The invention claimed is:

1. A cable connector comprising a housing and ferrule receiving structures for receiving ferrule systems of at least two cables characterized in that each of said ferrule receiving structures is adapted to accommodate a flange of at least one of said ferrule systems and said ferrule receiving structures are arranged such that adjacent flanges of said ferrule systems substantially abut each other or at least partially overlap, wherein said housing comprises a first cover half and a second cover half, said first cover half and second cover half defining a split plane (S) of said connector, each of said ferrule receiving structures being arranged substantially symmetrically with respect to said split plane (S).

2. A cable connector comprising a housing and ferrule receiving structures for receiving ferrule systems of at least two cables characterized in that each of said ferrule receiving structures is adapted to accommodate a flange of at least one of said ferrule systems and said ferrule receiving structures are arranged such that adjacent flanges of said ferrule systems substantially abut each other or at least partially overlap, wherein said ferrule receiving structures comprise a non-circular shaped section adapted to cooperate with a corresponding non-circular shaped part of said ferrule system.

3. A cable connector comprising a housing and at least a first ferrule receiving structure for receiving a first ferrule system comprising a flange of a first cable and a second ferrule receiving structure for receiving a second ferrule system of a second cable characterized in that said first receiving structure and second receiving structure are sized and shaped to receive said flange such that said flange directly contacts said second ferrule system to close said cable connector near a cable entry.

4. A cable connector housing comprising a first ferrule receiving structure, which is sized and shaped to receive a first ferrule system comprising a flange of a first cable, and a second ferrule receiving structure which is sized and shaped to receive a second ferrule system of a second cable, the first receiving structure and the second receiving structure being sized and shaped to receive the flange, and locate the first and second ferrule systems relative to each other, such that the flange directly contacts the second ferrule system to close an opening through the cable connector housing near a cable entry.

5. A cable connector comprising:

a housing with a cable entry;

a first ferrule receiving configuration which is sized and shaped to receive a first ferrule system of a first cable, wherein the first ferrule receiving configuration comprises a groove for receiving a flange of the first ferrule system; and a second ferrule receiving configuration which is sized and shaped to receive a second ferrule system of a second cable, wherein the first and second ferrule receiving configurations are sized and shaped to locate the first and second ferrule systems to directly contact each other and close an opening of the cable connector at the cable entry.

6. A cable connector comprising a housing and ferrule receiving structures for receiving ferrule systems of at least two cables characterized in that each of said ferrule receiving structures is adapted to accommodate a flange of at least one of said ferrule systems and said ferrule receiving structures are arranged such that adjacent flanges of said ferrule systems substantially abut each other or at least partially overlap, wherein said cable entry comprises one or more retention ribs.

7. The cable connector according to claim 6, wherein said housing comprises a first cover half and a second cover half, said first cover half and second cover half defining a split plane (S) of said connector, and said retention ribs are chamfered with respect to said split plane (S).

8. A cable connector comprising:

a housing with a cable entry;

a first ferrule receiving structure which is sized and shaped to receive a first ferrule system of a first cable; and a second ferrule receiving structure which is sized and shaped to receive a second ferrule system of a second cable, wherein the first and second ferrule receiving structures are sized and shaped to locate the first and second ferrule systems to directly contact each other and close the cable connector near the cable entry.

9. A cable connector assembly comprising:

a cable connector according to claim 8 and a first cable provided with the first ferrule system comprising a first flange and an adjacent second cable provided with the second ferrule system comprising a second flange, wherein said first ferrule system and second ferrule system are adapted to receive a portion of respectively said adjacent second flange and said adjacent first flange.

10. The cable connector assembly according to claim 9, wherein each ferrule system comprises an inner ferrule and an outer ferrule arranged with respect to each other to determine a gap to receive said portion of said adjacent flange.

11. An assembly comprising:

a cable connector according to claim 8; and a first ferrule system in the first ferrule receiving structures, wherein said first ferrule system comprises a first flange and a structure to receive a second flange of the second ferrule system.

12. An assembly according to claim 11, wherein said first ferrule system comprises an inner ferrule and an outer ferrule arranged with respect to each other to determine said structure to receive said second flange.

13. An assembly according to claim 12, wherein said first ferrule system has an outer shape selected from the group comprising polygonal, hexagonal, square, elliptical, and D-shaped.

* * * * *